US010334354B2

(12) United States Patent
Qin

(10) Patent No.: US 10,334,354 B2
(45) Date of Patent: Jun. 25, 2019

(54) SPEAKER BOX

(71) Applicant: AAC Technologies Pte. Ltd., Singapore (SG)

(72) Inventor: Peng Qin, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/856,855

(22) Filed: Dec. 28, 2017

(65) Prior Publication Data

US 2019/0014406 A1 Jan. 10, 2019

(30) Foreign Application Priority Data

Jul. 4, 2017 (CN) ..... 2017 1 0539785

(51) Int. Cl.

| | |
|---|---|
| ***H04R 1/02*** | (2006.01) |
| ***H04R 1/28*** | (2006.01) |
| ***H04R 1/34*** | (2006.01) |
| ***H04R 31/00*** | (2006.01) |
| ***H04R 9/06*** | (2006.01) |
| *H04R 29/00* | (2006.01) |

(52) U.S. Cl.

CPC ..... *H04R 1/2888* (2013.01); *H04R 1/021* (2013.01); *H04R 1/025* (2013.01); *H04R 1/2803* (2013.01); *H04R 1/2811* (2013.01); *H04R 1/345* (2013.01); *H04R 9/06* (2013.01); *H04R 31/003* (2013.01); *H04R 1/023* (2013.01); *H04R 1/288* (2013.01); *H04R 29/001* (2013.01); *H04R 2499/11* (2013.01)

(58) Field of Classification Search

CPC ..... H04R 1/02; H04R 1/023; H04R 1/025; H04R 1/2803; H04R 1/2834; H04R 1/2888; H04R 1/345; H04R 2499/11; H04R 1/021; H04R 1/2811; H04M 1/035

USPC ..... 381/338, 345, 350, 351, 353, 354, 357, 381/386, 391, 189; 181/145, 155, 156, 181/199; 379/430

See application file for complete search history.

(56) References Cited

U.S. PATENT DOCUMENTS

| | | | | | |
|---|---|---|---|---|---|
| 4,058,688 | A * | 11/1977 | Nishimura | ..... | H04R 1/1008 381/354 |
| 5,263,093 | A * | 11/1993 | Nakamura | ..... | H04R 9/08 381/177 |
| 6,002,949 | A * | 12/1999 | Hawker | ..... | H04M 1/0202 361/814 |
| 2017/0134848 | A1 * | 5/2017 | Shao | ..... | H04R 1/2834 |

* cited by examiner

*Primary Examiner* — Huyen D Le
(74) *Attorney, Agent, or Firm* — Na Xu; IPro, PLLC

(57) ABSTRACT

A speaker box includes a housing and a speaker unit accommodated in the housing. The speaker unit includes a diaphragm for forming a front sound cavity cooperatively with the housing. A sound transmitting channel communicates the front sound cavity with the outside for forming a front cavity of the speaker box. A through hole is formed at a position on the housing corresponding to the front cavity. The speaker box further includes an elastic cover plate provided on a side of the housing close to the diaphragm for covering the through hole and for absorbing vibration energy at a specific resonance frequency. A Young's modulus or strength of the elastic cover plate is smaller than that of the housing.

6 Claims, 2 Drawing Sheets

SPEAKER BOX

CROSS-REFERENCE TO RELATED APPLICATIONS

This application claims the priority benefit of Chinese Patent Application Ser. No. 201710539785.3 filed on Jul. 4, 2017, the entire content of which is incorporated herein by reference.

FIELD OF THE PRESENT DISCLOSURE

The present disclosure relates to electro-acoustic transducers, more particularly to a housing of a speaker box.

DESCRIPTION OF RELATED ART

With the arrival of mobile internet era, the number of intelligent mobile devices is on the increase. Among the many mobile devices, mobile phones are undoubtedly the most common, most portable mobile terminal devices. At present, the mobile phone functions are extremely diverse, one of which is high quality music function, therefore, the speaker boxes used to play sounds are applied to current smart mobile devices in large quantities.

The speaker box of relative art comprises a housing, a speaker unit accommodated in the housing, a through hole provided as penetrating the housing and a cover plate provided as covering the through hole, the speaker unit comprises a diaphragm for vibration and sound producing, the diaphragm and the housing are provided spaced apart to form a front sound cavity, the through hole and the diaphragm are provided rightly opposite each other, the speaker box also comprises a sound transmitting channel connecting the front sound cavity and the external environment, the front sound cavity and the sound channel form together the front cavity of the speaker box.

However, in the speaker box of related art, the inner walls of the front cavity are all rigid walls made up of rigid plastic material or metal material, the damp and the vibration amplitude of a rigid wall are small, its radiation energy is limited, and cannot effectively transmit the cavity energy in the front cavity out, thus it cannot absorb the energy of a specified frequency. Therefore, the rigid walls of the front cavity are prone to resonance because of the structure, which will then lead to sound distortion in the speaker box, affecting the acoustic performance of the speaker box.

Therefore it is necessary to provide an improved speaker box for overcoming the above-mentioned disadvantages.

BRIEF DESCRIPTION OF THE DRAWINGS

Many aspects of the exemplary embodiment can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiments. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
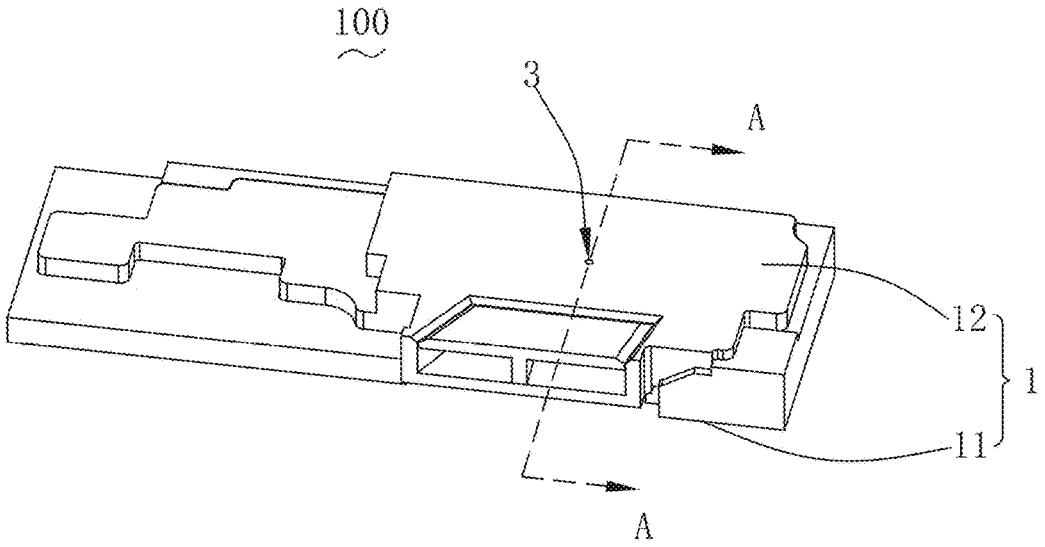
FIG. 1 is an isometric view of a speaker box in accordance with an exemplary embodiment of the present disclosure.
Figure 2:
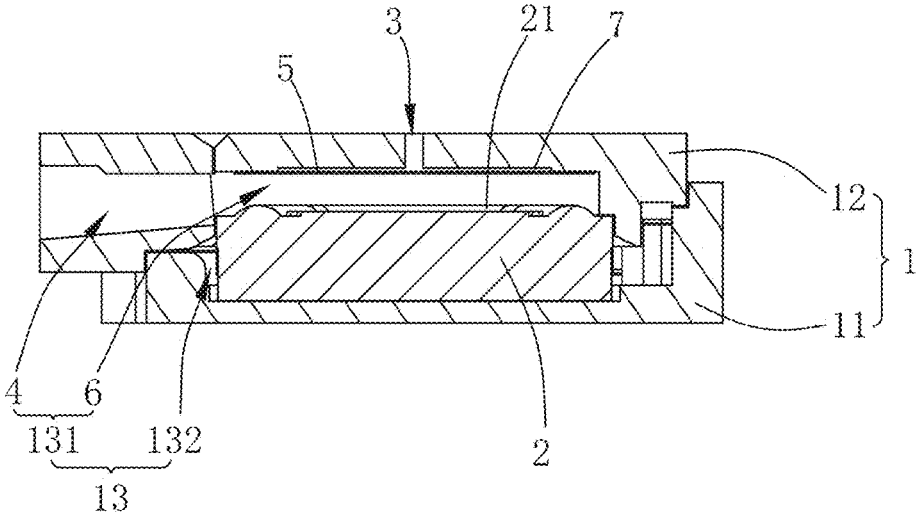
FIG. 2 is a cross-sectional view of the speaker box, taken long line A-A in FIG. 1.

Please refer to FIGS. 1-2, the present invention provides a speaker box 100 comprising a housing 1, a speaker unit 2, a through hole 3, a sound transmitting channel 4 and an elastic cover plate 5.

The speaker unit 2 is accommodated in the housing 1. In this embodiment, the housing 1 comprises a lower plate 11 and an upper cover 12 which form jointly with the lower plate 11 an accommodating space 13. The speaker unit 2 is fixed in the accommodating space 13.

The speaker unit 2 comprises a diaphragm 21 for vibration and sound producing, the diaphragm 21 and the housing 1 are provided spaced apart to form a front sound cavity 6. Specifically, the diaphragm 21 and the upper cover 12 form jointly the front sound cavity 6.

The through hole 3 is provided as penetrating the housing 1 and is connected with the front sound cavity 6. In the present embodiment, the through hole 3 is provided as penetrating the upper cover 12. Preferably, the through hole 3 and the diaphragm 21 are provided rightly opposite each other.

The sound transmitting channel 4 is formed in the housing 1, specifically, the sound transmitting channel 4 is formed on the upper cover 12. The sound transmitting channel 4 connects the front sound cavity 6 with the outside, by which a side sound producing structure is formed. That is to say, in this embodiment, the diaphragm 21 (the speaker unit 2) divides accommodating space 13 into a front cavity 131 and the back cavity 132, in which, the front cavity 131 comprises the front sound cavity 6 and the sound transmitting channel 4, which are used for transmitting sound; the back cavity 132 has the function of improving the low frequency acoustic performance of the speaker box 100.

That is, the through hole 3 is provided at the position on the housing 1 corresponding to the front cavity 131, which penetrates the housing 1 and connects the front cavity 131 with the outside.

The elastic cover plate 5 is provided in the front cavity 131 and fixed at the side of the housing 1 close to the diaphragm 21 and covers the through hole 3, and it is used for absorbing the vibration of a particular resonant frequency. The Young's modulus or strength the elastic cover plate 5 is smaller than that of the housing 1 (preferably, the upper cover 12).

In this invention, the elastic cover plate 5 will replace the rigid wall of related art, and the elastic cover plate 5 has a resonant frequency, when, through design, the resonant frequency of the elastic cover plate is adjusted to a certain frequency, the elastic cover plate 5 will produce strong vibration near the resonance frequency, when the speaker box 100 produces sounds and the speaker unit 2 vibrates, the air in the front cavity will be compressed and energy will be produced, this energy will drive the elastic cover plate 5 to vibrate, thus the energy in the front cavity will be consumed, preferably, the elastic cover plate 5 vibrates at the resonant frequency, under which condition the vibration intensity will reach the maximum, thus more energy can be consumed; and thus the aim of absorbing energy near the specific frequency can be achieved; in addition, by replacing the rigid wall with the elastic cover plate 5, the medium density in the front cavity 131 can be transmitted to the outside of the front cavity 131, thereby reducing the resonance phenomenon of the speaker box 100 and improving distortion.

Specifically, the purposes mentioned above are achieved by designing the material, area, shape and thickness of the elastic cover plate 5. In this embodiment, the elastic cover plate 5 is made of material with low Young's modulus or strength, at least below that of the upper cover 12, such as TPU or MCP or silica gel. Then they are fixedly connected by double-shot molding or hot pressing or pasting or ultrasonic welding, forming part of the structure of the front cavity 131, absorbing the energy in the front cavity 131 of the speaker box 100 near resonant peak, and achieving the purpose of decreasing resonance peak, reducing distortion and improving the acoustic performance of the speaker box 100. The elastic cover plate 5 can be designed and adjusted according to the range of the resonant frequency that needs to be absorbed. The specific resonant frequency is just the set range of resonance frequency that needs to be absorbed.

Figure 3:
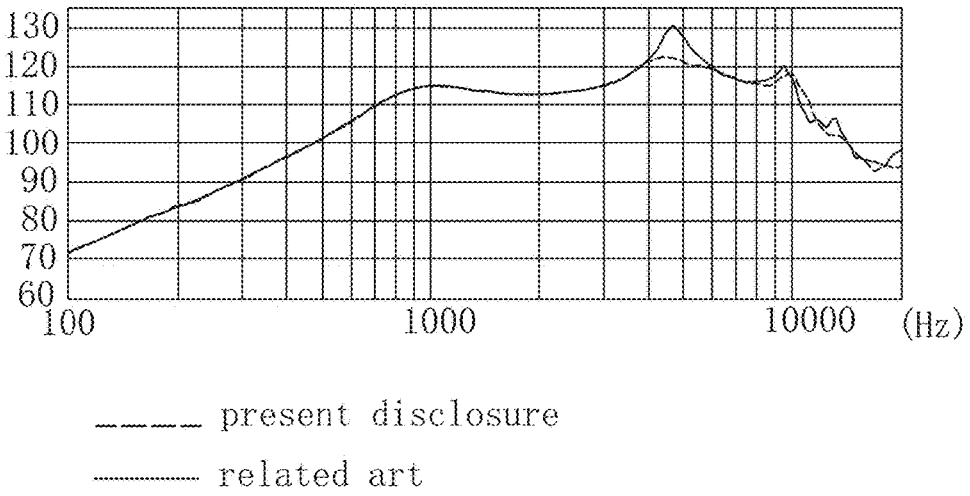
FIG. 3 shows a comparison of frequency response curves between the speaker box of the present disclosure (using an elastic cover plate) and a speaker box (using a rigid wall) of the related art.

Please refer to FIG. 3, a frequency response curve of the elastic cover plate of the speaker box of the invention and a rigid wall of the related art. As shown in FIG. 3, in the frequency response curve of the elastic cover plate 5 the speaker box 100 of the invention, the resonance peak decreases obviously, meaning the resonance phenomenon is reduced.

Figure 4:
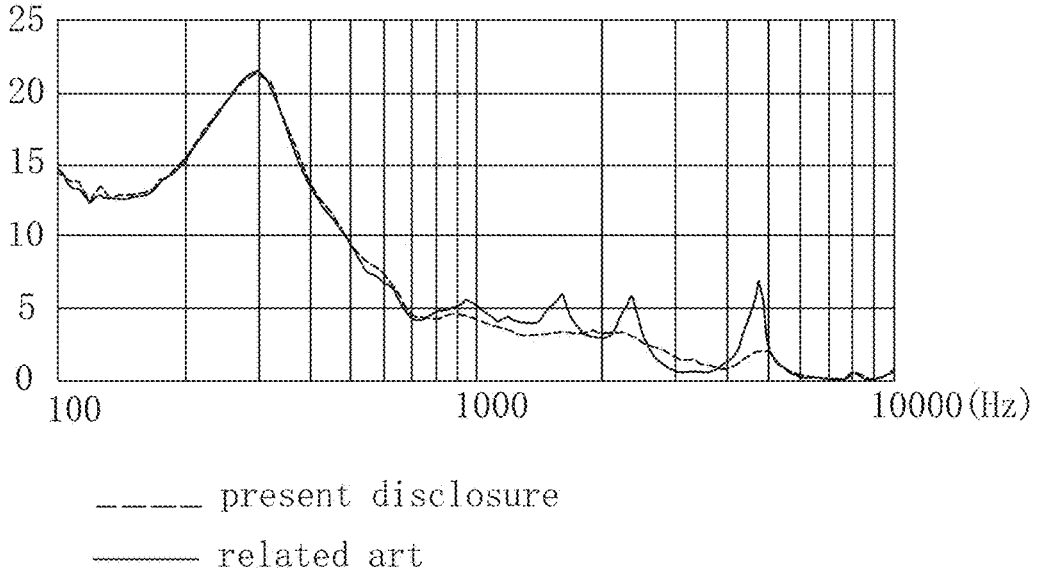
FIG. 4 shows a comparison of total harmonic distortion curves of the speaker box (using an elastic cover plate) of the present disclosure and a speaker box (using a rigid wall) of the related art.

Please refer to FIG. 4, a total harmonic distortion curve of the elastic cover plate of the speaker box of the invention and a rigid wall of the related art. As shown in FIG. 4, in the total harmonic distortion curve of the elastic cover plate 5 the speaker box 100 of the invention, the distortion spike decreases obviously, meaning distortion is reduced.

In the speaker box 100 of the invention, the resonance frequency of the elastic cover plate 5 is 500-15000 Hz;

When the resonance frequency of the elastic cover plate 5 is 500-1500 Hz, the distortion near the low frequency resonance frequency f0 of the speaker box 100 can be reduced, the second time distortion near the corresponding f0/2 can be reduced, the third time distortion near the f0/3 can be reduced, etc.;

When the resonance frequency of the elastic cover plate 5 is 1500-3000 Hz, the medium frequency distortion near 2000 Hz of the speaker box 100 can be reduced, the second time distortion near the corresponding 1000 Hz can be reduced, the third time distortion near 667 Hz can be reduced, etc.;

When the resonance frequency of the elastic cover plate 5 is 3000-9000 Hz, the distortion near the high frequency resonance peak Fh of the speaker box 100 can be reduced, the second time distortion near the corresponding Fh/2 can be reduced, the third time distortion near Fh/3 can be reduced, etc.;

When the resonance frequency of the elastic cover plate 5 is 9000-15000 Hz, the distortion near the high frequency 12000 Hz of the speaker box 100 can be reduced, the second time distortion near the corresponding 6000 Hz can be reduced, the third time distortion near 4000 Hz can be reduced, etc.

Please refer to FIG. 4, a frequency response curve of the acoustic performance test data of the speaker box of the present invention. According to the experimental data and effects, in this embodiment, the elastic cover plate 5 preferably absorbs vibration at a resonance frequency of 3000~9000 Hz, under this condition, the distortion reducing effect of the speaker box 100 is better.

In the embodiment, the elastic cover plate 5 is fixed at the upper cover 12 and is provided rightly opposite the diaphragm 21. Specifically, the elastic cover plate 5 and the upper cover 12 of the housing 1 are fixedly connected by double-shot molding or hot pressing or pasting or ultrasonic welding. Of course, the methods to fix the two are not limited to this.

To make sure that the through hole 3 can leak sound pressure stably, a gap is provided between the elastic cover plate 5 and the upper cover 12 of the housing 1, forming a pressure leaking space.

For example, a groove 7 is formed with the surface of the upper plate 12 opposite the diaphragm 21 sinking toward the direction far from the diaphragm 21, the groove 7 is connected with the through hole 3, the elastic cover plate 5 is fixed on the surface of the upper plate 12 facing the diaphragm 21 and covers the groove 7. The groove 7 forms thus the gap structure.

It needs to be pointed out that, the elastic cover plate 5 is provided to absorb the specific resonance frequency energy of the front cavity 131, therefore, the structure of the elastic cover plate 5 is not limited to be provided as the above structure, its position is not limited to the above position, either. It can also be provided in the sound transmitting channel 4.

Compared with the related art, the speaker box of the invention provides an elastic cover plate with Young's modulus or strength smaller than that of the housing in the front cavity, to absorb the vibration at a specific resonance frequency, thus weakening the resonance effect of the speaker box, reducing its distortion, and thus improving the acoustic performance of the speaker box.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker box, comprising:

a housing, the housing comprises a lower plate and an upper plate for forming an accommodation space with the lower plate;

a speaker unit fixed in the accommodation space, the speaker unit includes a diaphragm, the diaphragm and the upper plate form a front sound cavity;

a sound transmitting channel communicating the front sound cavity with the outside for forming a front cavity of the speaker box, the sound transmitting channel is formed at the upper plate;

a through hole provided at the upper plate corresponding to the front cavity;

an elastic cover plate fixed on the surface of the upper plate opposite the diaphragm for covering the through hole and for absorbing vibration energy in the front cavity at a specific resonance frequency; wherein a Young's modulus or strength of the elastic cover plate is smaller than that of the housing;

a gap is provided between the elastic cover plate and the upper plate.

2. The speaker box as described in claim 1, wherein a groove is formed in a surface of the upper plate opposite to the diaphragm sinking toward a direction far away from the diaphragm for communicating with the through hole, the elastic cover plate is fixed on the surface of the upper plate facing the diaphragm and covers the groove.

3. The speaker box as described in claim 2, wherein the elastic cover plate and the upper plate are fixedly connected by double-shot molding or hot pressing or pasting or ultrasonic welding.

4. The speaker box as described in claim 1, wherein the specific frequency is 500~15000 Hz.

5. The speaker box as described in claim 4, wherein the specific frequency is 3000~9000 Hz.

6. The speaker box as described in claim 1, wherein the elastic cover plate is made of TPU or silica gel.

* * * * *